US006467713B1

(12) United States Patent
Watanabe et al.

(10) Patent No.: US 6,467,713 B1
(45) Date of Patent: Oct. 22, 2002

(54) TRACTION DEVICE FOR MEDICAL USE

(75) Inventors: Yasuo Watanabe; Satoshi Ishida, both of Shinjuku-ku (JP)

(73) Assignee: Kabushikikaisha Nihon M.D.M. (JP)

( * ) Notice: Subject to any disclaimer, the term of this patent is extended or adjusted under 35 U.S.C. 154(b) by 0 days.

(21) Appl. No.: 09/703,146

(22) Filed: Oct. 31, 2000

(30) Foreign Application Priority Data

Mar. 17, 2000 (JP) ..... 2000-075345

(51) Int. Cl.[7] ..... B65H 75/30; B65H 75/48

(52) U.S. Cl. ..... 242/375.1; 242/377; 242/380; 242/381; 602/33

(58) Field of Search ..... 242/375.1, 381, 242/380, 377, 397.5; 602/33

(56) References Cited

U.S. PATENT DOCUMENTS 1,915,632 A * 6/1933 Marks ..... 242/397.5
2,282,653 A * 5/1942 Herzmark ..... 242/375.1
2,596,648 A * 5/1952 Bugg et al. ..... 242/375.1
2,997,250 A * 8/1961 Collins ..... 242/375.1
3,065,925 A * 11/1962 Appleton ..... 242/375.1
3,151,823 A * 10/1964 Clarke ..... 242/375.1
3,246,363 A * 4/1966 Rogas et al. ..... 242/375.1
4,408,925 A * 10/1983 Louie
4,446,884 A * 5/1984 Rader ..... 242/381
5,025,802 A * 6/1991 Laico et al.
6,086,007 A * 7/2000 Till ..... 242/381

* cited by examiner

*Primary Examiner*—John M. Jillions
(74) *Attorney, Agent, or Firm*—Adams & Wilks

(57) ABSTRACT

A traction device has a casing, a drum mounted in the casing for undergoing rotation, and a traction rope having a first end connected to the drum and a second end extending through an opening in the casing. A roller is disposed in the casing for guiding the traction rope and a biasing member for resiliently biasing the traction rope onto the roller. A spring has a first end connected to the drum for urging the drum in a direction of rewinding the traction rope on the drum. A rope coupling is connected to the second end of the traction rope for preventing the second end of the traction rope from passing through the opening of the casing. A tension meter is disposed between the traction rope and the rope coupling for measuring a tension of the traction rope. A shaft is supported by the casing for undergoing rotation relative to the drum and is connected to a second end of the spring. A ratchet mechanism rotates the shaft to apply an initial load to the spring.

3 Claims, 4 Drawing Sheets

TRACTION DEVICE FOR MEDICAL USE

BACKGROUND OF THE INVENTION

1. Field of the Invention

The present invention relates to a traction device for performing traction with a rope, and more particularly to a traction device for medical use which is adapted for correcting an affected part of a patient having a fracture in his or her arm, leg, cervical vertebrae or the like by pulling such affected part.

2. Description of the Related Art

As a conventional traction device for medical use, one shown in FIG. 4 which is invented in Holland is known. To operate this traction device, first of all, a rope 2, which is wound around a drum 1 with one end thereof held at the drum 1, is paid out to allow the other end thereof to be attached to, e.g., a foot of a patient. Next, the drum 1 is fixed by tightening a lock handle 3. Thereafter, a spiral spring inside the drum 1 is tightened by rotating a handle 4, whereby the drum 1 is imparted a potential energy for rewinding the rope 2. Traction is thus performed as the rope 2 becomes tense due to the drum 1 being urged by the spiral spring.

In the aforementioned conventional traction device for medical use, in order to rewind the rope 2 onto the drum 1 after a fitting attached to the other end of the rope 2 has been removed from the foot of the patient, an operator is required to hold the rope 2 with his or her hand so that the 2 will be reversely wound around the drum 1 quietly. If the rope 2 is not thus held, the spiral spring inside the drum 1 pulls the rope 2 rapidly back onto the drum 1, making it likely that not only an operator such as a nurse will be exposed to danger, but also the rope 2 will be jammed on the drum 1 so that the traction device is not readily usable for subsequent operations.

SUMMARY OF THE INVENTION

It is therefore an object of the present invention to provide a traction device for use in medical therapy which is easy to operate and highly safe, and which allows a traction rope to be rewound an a drum in an orderly way.

In one aspect, the present invention provides a traction device for medical use, which comprises a drum for rewinding a traction rope while holding a tail end of the rope, a casing for rotatably supporting the drum therein, a spring for urging the drum in a direction of rewinding the rope, a rope coupling attached to a head end of the rope paid out from a rope entrance provided in the casing for blocking the pulling in of the head end of the rope, a first gear provided so as to be rotatable integrally and in a manner concentric with the drum, and a rotary damper having a second gear, which is a small reduction gear meshed with the first gear, and being installed inside the casing.

In another aspect, the present invention provides a traction device for medical use, wherein a tension meter for indicating a tension of the rope is interposed between the rope and the rope coupling.

In still another aspect, the present invention provides a traction device for medical use, wherein a roller for guiding the rope and a biasing piece for resiliently biasing the rope onto the roller are provided in the vicinity of the rope entrance provided in the casing.

In still another aspect, the present invention provides a traction device for medical use, wherein the spring is constructed of a spiral spring contained in a hollow portion of the drum, one end of the spiral spring which is located at the center is fixed to a central shaft which is loosely fitted into the drum in a manner concentric with the drum and supported on the casing, the other end of the spiral spring is fixed to an inner circumferential wall portion located in the hollow portion of the drum, and an adjusting member integrally rotatable with the central shaft for adjustably applying an initial load to the spiral spring is releasably attached to the outside of the casing.

In the above-mentioned traction device for medical use, the drum for rewinding the traction rope is coupled to the rotary damper at all times through the second gear, which is a small reduction gear meshed with the first gear that is integrated with the drum, even when the spring urges the drum in the direction of rewinding the rope. As a result, when the rope is removed from the affected part of a patient suffering a fracture, it is not likely to be drawn back onto the drum violently. Hence, the rewinding operation can be performed at such mild speeds as not to expose an operator such as a nurse to danger.

Further, since all components such as the drum and the damper are installed inside the casing, the traction device can be handled with more ease.

When the tension meter is provided between the rope and the rope coupling, the tension meter can constantly monitor the tractive force applied to the affected part of a patient, thereby allowing a desired traction condition to be maintained.

If the roller for guiding the rope and the biasing piece, which is a flat spring-like piece, for resiliently biasing the rope onto the roller are provided in the vicinity of the rope entrance provided in the casing, during the rewinding operation of the rope onto the drum after a therapy with this traction device has been completed, the damper and the reduction mechanism constructed of the gears jointly act to decelerate the rope pulling speed, and further, the additional action of the biasing piece that biases the rope onto the roller prevents the rope from whirling and bouncing. Therefore, the rope can be rewound onto the drum neatly, thereby eliminating such inconvenience that the operator will have difficulty handling the rope during the next operation.

When a spiral spring is used as the spring and is inserted into the drum, and when the adjusting member for applying an initial load to the spiral spring is releasably attached to the outside of the casing, an initial tractive force can be set properly in the order of 10 N (≈1 kgf) in advance, and hence the operator can use the traction device in hospitals in an extremely simple way.

When a ratchet plate is used as the adjusting member and the ratchet plate meshes with the rotary pawl having a spring attached thereto, the initial load can be applied to the spiral spring easily by rotating the ratchet plate intermittently.

BRIEF DESCRIPTION OF THE DRAWINGS

The present invention will be described in further detail with reference to the accompanying drawings, in which.

DETAILED DESCRIPTION OF THE PREFERRED EMBODIMENT

Figure 1:
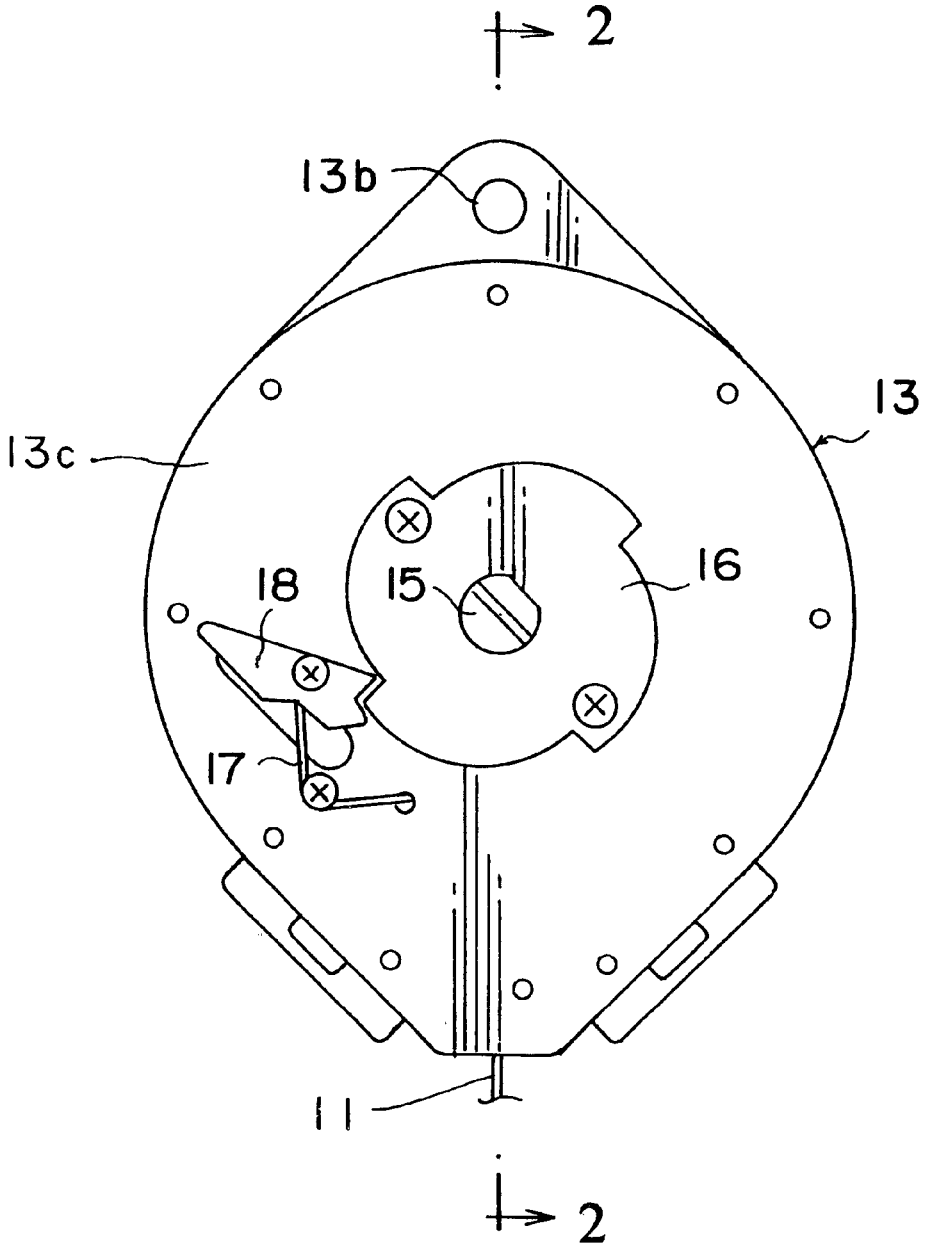
FIG. 1 is a front view showing a traction device for medical use, which is an embodiment of the present invention, with a cover plate thereof removed.
Figure 2:
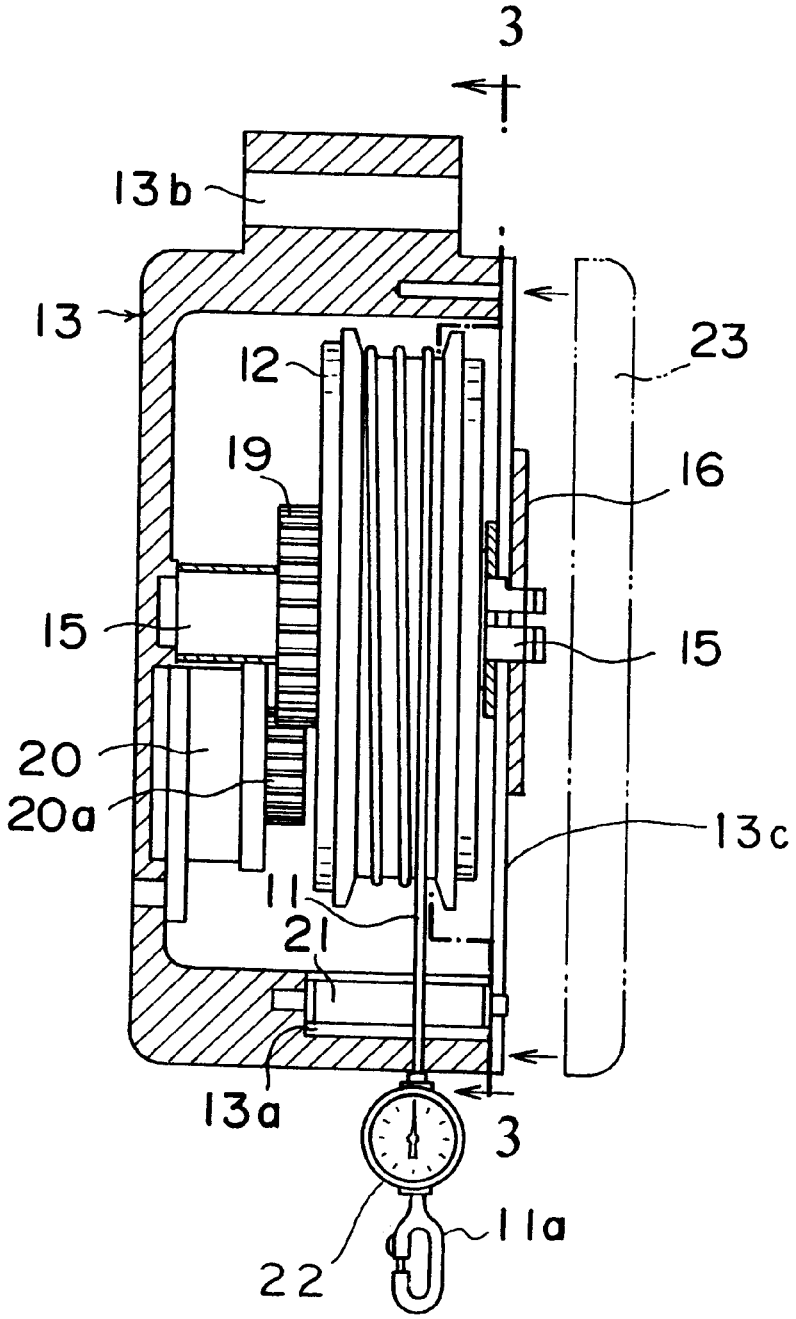
FIG. 2 is a sectional view taken along a line 2—2 in FIG. 1.
Figure 3:
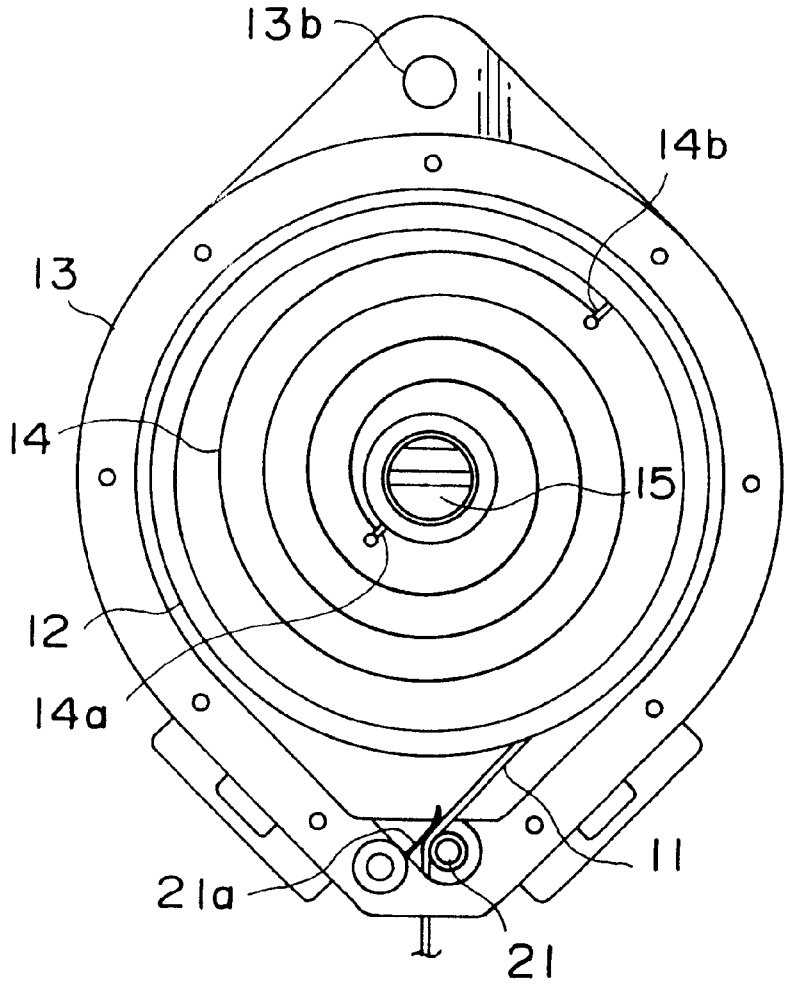
FIG. 3 is a view taken along a line 3—3 in FIG. 2.
Figure 4:
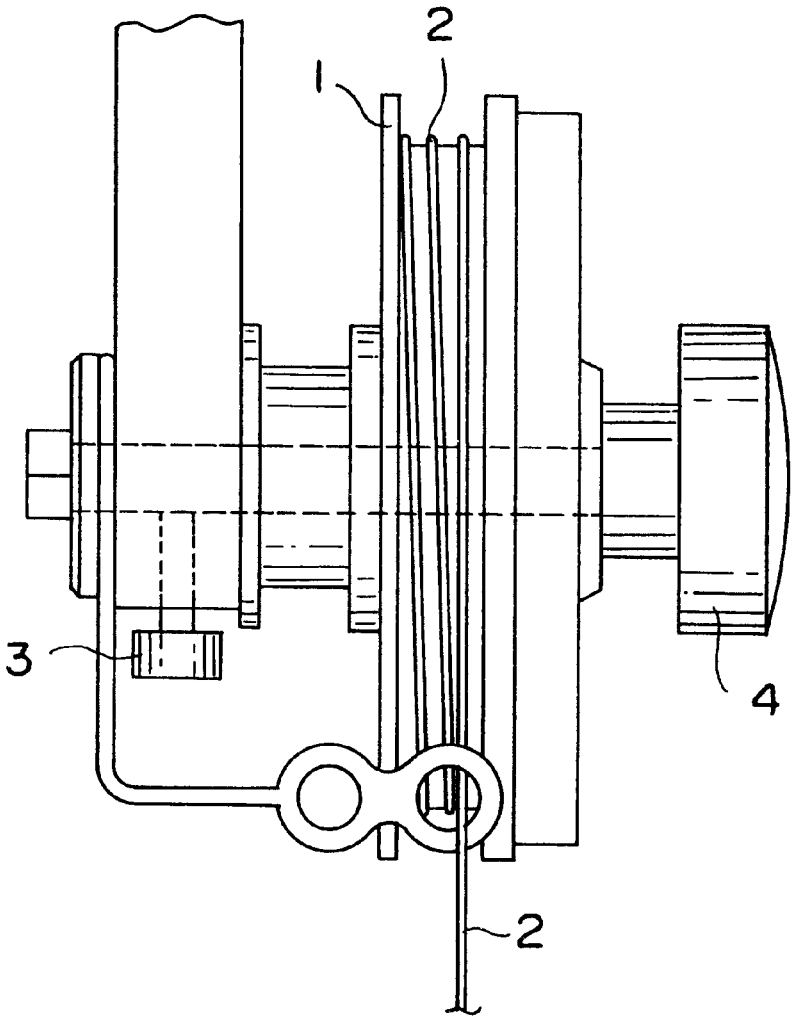
PRIOR ART FIG. 4
FIG. 4 is a side view showing an exemplary conventional traction device for medical use.

Referring now to FIGS. 1 to 3, there is shown a traction device for medical use, which is an embodiment of the present invention. In the traction device for medical use, a drum 12, which is designed to rewind a traction rope 11 with a tail end of the rope 11 fixed thereto is rotatably supported inside a casing 13, and a spiral spring 14 for urging the drum 12 in a direction of rewinding the rope 11 is fitted into the drum 12.

More specifically, one end 14*a* of the spiral spring 14 which is located at the center is fixed to a central shaft 15, and the other end 14*b* thereof is fixed to an inner circumferential wall portion located in a hollow portion of the drum 12. Thus, the central shaft 15 functions as a driving shaft for tightening the spiral spring 14, and is supported by the casing 13 while loosely fitted into the drum 12 in a manner concentric with the drum 12. Further, there is provided a ratchet plate 16 that serves as an adjusting member capable of rotating integrally with the central shaft 15 when the shaft 15 is rotated by a screwdriver or the like in order to apply an initial load to the spiral spring 14. The ratchet plate 16 is designed such that it can be attached to a side plate 13*c* of the casing 13 with screws after the central shaft 15 has been rotated. Note that the ratchet plate 16 engages with a rotary pawl 18 having a spring 17 attached thereto and that a ratchet mechanism being thus constructed can hence rotate the central shaft 15 intermittently.

The drum 12 can rotate about the central shaft 15 integrally with a gear 19. The gear 19 meshes with a small reduction gear 20*a* of an oil-stirred rotary one-way damper 20 that is mounted on an inner wall of the casing 13.

Further, a roller 21 is disposed in the vicinity of a rope entrance 13*a* formed in the casing 13 so as to guide the rope 11. As shown in FIG. 3, a biasing piece 21*a* is arranged for biasing the rope 11 resiliently onto the roller 21.

Still further, a rope coupling 11*a* is provided in order to allow the rope 11 to be used to stretch a fractured arm, leg or the like of a patient who is lying on a bed in a hospital. As shown in FIG. 2, between the rope coupling 11*a* and the rope 11 is a tension meter 22 for indicating the tension of the rope 11.

Even when the tension meter 22 is removed, the rope coupling 11*a* functions to prevent a head end of the rope 11 from being drawn back into the rope entrance 13*a*.

Examples of the tension meter 22 include a spring scale type and a load cell type. Further, as shown in FIG. 2, a cover plate 23 for concealing the ratchet plate 16 is releasably attached to the casing 13, and a mounting hole 13*b* for mounting the traction device near a bed on which a patient is lying is formed in an upper portion of the casing 13.

In the above-mentioned traction device for medical use according to this embodiment, the rotary one-way damper 20 is connected to the drum 12 at all times through the small reduction gear 20*a* that is meshed with the gear 19 integrated with the drum 12. Therefore, even if the spiral spring 14 urges the drum 12 to keep the drum 12 ready to rewind the rope 11, the damper 20 intervenes upon removal of the rope 11 from a patient suffering a fracture, thereby preventing the traction rope 11 from being rewound onto the drum 12 violently. Hence, the operation of rewinding the rope can be performed at such mild speeds as not to harm an operator such as a nurse.

Further, all components such as the drum 12 and the damper 20 are disposed within the casing 13. Therefore, the traction device can be handled with more ease.

Still further, the tension meter 22 is interposed between the rope 11 and the rope coupling 11*a*. Therefore, the tractive force applied to the affected part of a patient can be monitored constantly, thereby allowing a desired traction condition to be maintained.

Moreover, the roller 21 for guiding the rope 11 and the flat spring-shaped biasing piece 21*a* for resiliently biasing the rope 11 onto the roller 21 are disposed in the vicinity of the rope entrance 13*a* provided in the casing 13. Therefore, when the rope 11 is to be rewound onto the drum 12 after a therapy using this traction device has been completed, the combined action derived from the damper 20 and the reduction mechanism comprised of the gears 19 and 20*a* slows down the rope pulling speed, and further the additional action by the biasing piece 21*a* biasing the rope onto the roller 21 prevents the rope 11 from whirling and bouncing. This, in turn, allows the rope 11 to be rewound onto the drum 12 in an orderly fashion, thereby eliminating inconvenience to be possibly encountered when the traction device is used next time.

Furthermore, when the spiral spring 14 is contained in the drum 12, and when the adjusting member (the ratchet plate 16 in this embodiment) that can apply an initial load to the spiral spring 14 is detachably attached to the outside of the casing 13, the initial tractive force can be set properly in the order of 10 N (≈1 kgf) in advance, thereby remarkably simplifying the handling of the traction device in hospitals.

When the adjusting member is constructed of the ratchet plate 16 and the plate 16 engages with the rotary pawl 18 having the spring 17 attached thereto, the ratchet plate 16 can be rotated intermittently, and thus the initial load can be applied to the spiral spring 14 easily.

While the spiral spring 14 is used as a spring for urging the drum 12 in the direction of rewinding the rope 11 in the aforementioned embodiment, a constant force spring may also be used. In such a case, the tractive load can be maintained constant independently of the length by which the rope 11 is paid out.

As described in detail in the foregoing, the traction device for medical use of the present invention can provide the following advantages:

(1) Since the drum for rewinding the traction rope is always connected to the rotary damper through the small reduction gear that is meshed with the gear integrated with the drum, even if the drum is biased by the spring in the direction of rewinding the rope, violence does not result while the rope is being rewound onto the drum after, for example, the rope has been removed from the affected part of a patient suffering a fracture. Therefore, the rope can be rewound at such mild speeds as not to expose an operator such as a nurse to danger. Further, since all components including the drum and the damper are installed inside the casing, the traction device can be handled with more ease.

(2) When the tension meter is interposed between the rope and the rope coupling, the tension meter can monitor the tractive force applied to the affected part of a patient constantly, thereby allowing a desired traction condition to be maintained.

(3) When the roller for guiding the rope and the flat spring-shaped biasing piece for resiliently biasing the rope onto the roller are disposed in the vicinity of the rope entrance formed in the casing, the joint action of the damper and the reduction mechanism constructed of the gears decelerates the rope pulling speed, and further the additional action by the biasing piece biasing the rope onto the roller prevents the rope from whirling and bouncing during the rewinding of the rope onto the drum after a therapy using this traction device has been completed. Therefore, the rope can be rewound onto the drum neatly, and hence the traction device is readily available without imposing inconvenience when used next time.

(4) When a spiral spring is employed as the spring and inserted into the drum, and when the adjusting member for applying an initial load to the spiral spring is releasably attached to the outside of the casing, an initial tractive force can be properly set in advance using the adjusting member, thereby allowing the operator to handle the traction device in hospitals in an extremely simple way.

(5) When a ratchet plate is employed as the adjusting member and the ratchet plate meshes with a rotary pawl having a spring attached thereto, the initial load can be applied to the spiral spring easily by rotating the ratchet plate intermittently.

What is claimed is:

1. A traction device comprising:

a casing having an interior portion, an exterior portion, and an opening communicating the interior and exterior portions;

a drum having a hollow portion and disposed in the interior portion of the casing for undergoing rotation to rewind a traction rope having a first end connected to the drum and a second end extending to the exterior portion of the casing through the opening thereof;

a roller disposed in the interior portion of the casing in the vicinity of the opening thereof for guiding the traction rope and a biasing member for resiliently biasing the traction rope onto the roller;

a gear disposed in the interior portion of the casing and connected to the drum for rotation therewith;

a rotary damper disposed in the interior portion of the casing and having a reduction gear meshed with the gear;

a shaft supported by the casing in concentric relation to the drum for undergoing rotation relative to the drum;

a spiral spring disposed in the hollow portion of the drum for urging the drum in a direction of rewinding the traction rope, the spiral spring having a first end connected to the shaft and a second end connected to an inner circumferential wall in the hollow portion of the drum;

a rope coupling connected to the second end of the traction rope for preventing the second end of the traction rope from being rewound into the interior portion of the casing; and an adjusting member releasably mounted on the exterior portion of the case and connected to the shaft for rotation therewith to apply an initial load to the spiral spring.

2. A traction device comprising:

a casing having an interior portion, an exterior portion, and an opening communicating the interior and exterior portions;

a drum having a hollow portion and disposed in the interior portion of the casing for undergoing rotation to rewind a traction rope having a first end connected to the drum and a second end extending to the exterior portion of the casing through the opening thereof;

a roller disposed in the interior portion of the casing in the vicinity of the opening thereof for guiding the traction rope and a biasing member for resiliently biasing the traction rope onto the roller;

a gear disposed in the interior portion of the casing and connected to the drum for rotation therewith;

a rotary damper disposed in the interior portion of the casing and having a reduction gear meshed with the gear;

a shaft supported by the casing in concentric relation to the drum for undergoing rotation relative to the drum;

a spiral spring disposed in the hollow portion of the drum for urging the drum in a direction of rewinding the traction rope, the spiral spring having a first end connected to the shaft and a second end connected to an inner circumferential wall in the hollow portion of the drum;

a rope coupling connected to the second end of the traction rope for preventing the second end of the traction rope from being rewound into the interior portion of the casing;

a tension meter disposed between the traction rope and the rope coupling for measuring a tension of the traction rope; and an adjusting member releasably mounted on the exterior portion of the case and connected to the shaft for rotation therewith to apply an initial load to the spiral spring.

3. A traction device comprising:

a casing;

a drum mounted in the casing for undergoing rotation;

a traction rope having a first end connected to the drum and a second end extending through an opening in the casing;

a roller disposed near the opening of the case for guiding the traction rope and a biasing member for resiliently biasing the traction rope onto the roller;

a spring for urging the drum in a direction of rewinding the traction rope on the drum, the spring having a first end connected to the drum and a second end;

a rope coupling connected to the second end of the traction rope for preventing the second end of the traction rope from passing through the opening of the casing;

a tension meter disposed between the traction rope and the rope coupling for measuring a tension of the traction rope;

a shaft supported by the casing for undergoing rotation relative to the drum and connected to the second end of the spring; and a ratchet mechanism for rotating the shaft to apply an initial load to the spring.

* * * * *